US009334138B1

(12) United States Patent
Herrmann

(10) Patent No.: US 9,334,138 B1
(45) Date of Patent: May 10, 2016

(54) HIGH SPEED MULTI-BIN CARD COLLATION AND BUFFERING SYSTEM

(71) Applicant: XEROX CORPORATION, Norwalk, CT (US)

(72) Inventor: Douglas K Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/699,196

(22) Filed: Apr. 29, 2015

(51) Int. Cl.

| | |
|---|---|
| ***B65H 39/10*** | (2006.01) |
| ***B65H 31/24*** | (2006.01) |
| ***B65H 39/115*** | (2006.01) |
| ***B65H 29/26*** | (2006.01) |
| ***B65H 29/58*** | (2006.01) |
| ***B65H 29/60*** | (2006.01) |
| ***B65H 31/30*** | (2006.01) |
| ***B65H 33/14*** | (2006.01) |
| ***B65H 33/16*** | (2006.01) |

(52) U.S. Cl.

CPC ..... *B65H 31/24* (2013.01); *B65H 29/26* (2013.01); *B65H 29/58* (2013.01); *B65H 29/60* (2013.01); *B65H 31/3054* (2013.01); *B65H 33/14* (2013.01); *B65H 33/16* (2013.01); *B65H 39/115* (2013.01); *B65H 2301/4213* (2013.01); *B65H 2301/42264* (2013.01)

(58) Field of Classification Search

CPC ..... B65H 29/26; B65H 29/58; B65H 29/585; B65H 29/60; B65H 31/24; B65H 31/30; B65H 31/3054; B65H 31/3063; B65H 31/3072; B65H 31/32; B65H 33/14; B65H 33/16; B65H 39/1115; B65H 2301/42; B65H 2301/421; B65H 2301/4213; B65H 2301/42132; B65H 2301/42134; B65H 2301/4226; B65H 2301/42264; B65H 2301/42265; B65H 2408/111

See application file for complete search history.

(56) References Cited

U.S. PATENT DOCUMENTS

| | | | | |
|---|---|---|---|---|
| 4,121,723 | A * | 10/1978 | Nellen | B65G 47/8815 198/592 |
| 5,097,960 | A * | 3/1992 | Tilles | B07C 3/06 209/584 |
| 5,235,883 | A * | 8/1993 | Jeske | B07C 5/36 271/303 |
| 8,770,911 | B2 | 7/2014 | Webb | |

OTHER PUBLICATIONS

U.S. Appl. No. 14/523,963, filed Oct. 27, 2014 and titled Taped Media Imposition for Adhesive In-Store Signage.

U.S. Appl. No. 14/524,018, filed Oct. 27, 2014 and titled Variable Guide System for Shingling In-Store Adhesive Signage.

U.S. Appl. No. 14/582,426, filed Dec. 24, 2014 and titled Multi-Stage Collation System and Method for High Speed Compiling of Sequentially Ordered In-Store Signage.

U.S. Appl. No. 14/594,711, filed Jan. 12, 2015 and titled Collation System With Retractable Guides.

* cited by examiner

*Primary Examiner* — Prasad Gokhale

(57) ABSTRACT

An automated high speed multi-bin card collation and buffering system that takes die cut greeting cards at high speeds and diverts them on a customer by customer basis into multiple bins. A series of diverters are included that actuate between customer jobs to divert and collate the jobs independently into the bins. The jobs are moved from the bins and buffered in a buffering zone for a predetermined period of time before being deposited onto a conveyor for conveying downstream for further processing. The buffering of the jobs allows for small jobs to be offset by larger jobs to increase average processing times for downstream systems, such as, banders to operate efficiently.

16 Claims, 4 Drawing Sheets

HIGH SPEED MULTI-BIN CARD COLLATION AND BUFFERING SYSTEM

BACKGROUND OF THE INVENTION

1. Field of the Invention

The presently disclosed embodiments are directed to providing a collation system, and more particularly, to a fully automated collation system that is capable of collating cards at high speed (e.g., 24,000/hr.).

2. Description of the Related Art

Currently, greeting cards are produced by tying high speed die cutters to high speed sheet feeders and continuously feeding up to 24,000 cards per hour in a 2-up configuration with 8 cards (4 per left and right side). A customer order can range from 2 to 100 cards per order and the orders are divided into 2-up lanes that stop and start randomly on either side of the sheet and not in the intercopy gap which leads to very high speed job to job changes. The cards need to be delivered to customers in collated and banded stacks. Presently, the output of the cards is shingled and manually collated in accordance with each customer's order and each order is manually banded. Usually, the demand for the cards is highly cyclical and to accommodate dramatic fluctuation in demand temporary workers are added at peak times. This causes several issues including: the high use of temporary workers to collate, band and sort the cards into sets; difficulty in locating and hiring the temporary workers; and defects introduced by the workers into the product (missed or incorrectly collated or banded sets).

Moreover, current greeting card collating, banding and sorting systems are dependent on temporary worker actions which are less predictable than an automated system. Examples of signage production and signage cutting/collating systems are described in U.S. patent application Ser. No. 14/523,963, filed on Oct. 27, 2014 and titled TAPED MEDIA IMPOSITION FOR ADHESIVE IN-STORE SIGNAGE, U.S. patent application Ser. No. 14/524,018, filed on Oct. 27, 2014 and titled VARIABLE GUIDE SYSTEM FOR SHINGLING IN-STORE ADHESIVE SIGNAGE, now U.S. Pat. No. 9,126,761, U.S. patent application Ser. No. 14/582,426, filed on Dec. 24, 2014 and titled MULTI-STAGE COLLATION SYSTEM AND METHOD FOR HIGH SPEED COMPILING OF SEQUENTIALLY ORDERED IN-STORE SIGNAGE, U.S. patent application Ser. No. 14/594,711, filed on Jan. 12, 2015 and titled COLLATION SYSTEM WITH RETRACTABLE GUIDES, along with U.S. patent application Ser. No. 14/699,186, filed on Apr. 29, 2015 and titled HIGH SPEED MULTI-BIN CARD COLLATION SYSTEM.

A conventional system that collates products is shown in U.S. Pat. No. 8,770,911 B2 that includes a collating conveyor that receives products sequentially from a delivery point and collates them into groups. A pusher transfers the groups of products from the conveyor to a receiving trough.

Therefore, in view of the known prior art, there is a still a need for a cost effective solution that will alleviate personnel demands for high speed greeting card lines.

SUMMARY OF THE INVENTION

In answer thereto, disclosed hereinafter is an automated high speed multi-bin card collation system that takes die-cut greeting cards at high speeds and diverts the cards on a customer by customer basis into multiple bins. A series of diverters are included that actuate between customer jobs to divert and collate the jobs independently into separate the bins. The cards are collected in the bins from right to left as viewed in FIG. 1 and then from left to right. While the left bins are being collated as a group, the filled right group of bins is pushed into a buffer system. The push takes place while the other bins are being filled. The buffer system works by collecting an entire row by taking first one set of bins then the other to create one row equaling the number of bins. The entire row is then moved while the next side of bins is being collated. In this way, the buffer system averages the total number of cards across the bins and buffers. This allows the buffer system to move at the rate of the largest set.

In an alternative embodiment, the cards are always collected in the bins from right to left as view in FIG. 4 with the cards in all of the bins being pushed in unison as a grouping into the buffer system. The push takes place while fresh cards are coming into the bins with the rightmost bin filled first.

BRIEF DESCRIPTION OF THE DRAWINGS

Various of the above-mentioned and further features and advantages will be apparent to those skilled in the art from the specific article or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
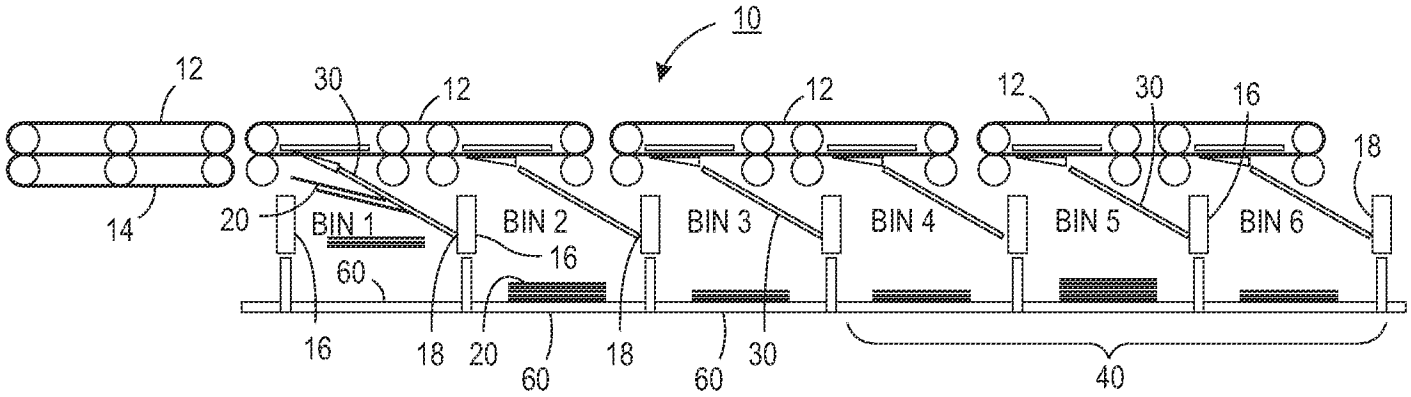
FIG. 1 is a schematic, partial side view illustration of a multi-bin collation system showing bins 4-6 already full and bins 1-3 just being filled. As the left most bins are being collated, bins 4-6 are being pushed out of the page to be buffered for a downstream process.

For a general understanding of the features of the disclosure, reference is made to the drawings. In the drawings, like reference numerals have been used throughout to identify identical elements.

In accordance with the present disclosure, two streams of greeting cards are provided with each stream sent to a series of Bins by diverting the stream of cards to sequential Bins based on customer meta data present on a header card for each set. The collation count is from 2 to over 100 cards per customer. The Bins are filled sequentially. That is, the first Bin to the right then the second from the right, etc., until all of the Bins are filled. The Bins are made up of 2 fixed vertical walls and 2 fixed walls that are part of a flighted pusher conveyor or pusher actuator system. The system operates by filling 3 (or half) of the 6 (or N) Bins right to left and then pushing those 3 sets in the cross process direction to a flighted buffer system while the next 3 bins are being filled. The next 3 of 6 Bins are then filled left to right. Or any number of Bins depending on what is optimal. For example, 5 Bins could be filled and dropped while collecting cards in Bin 1. An additional Bin can be used for any blank cards or if too many small sets are being fed to keep the system at the set through-put they can be out-sorted around the bander that is part of the architecture. Those cards are then dropped to an out-sort conveyor rather than a product conveyor if not banded. The number of Bins can by optimized as desired. The buffer allows the system to capture both small and large sets to increase the average processing time. This allows slower downstream processes to be used. Without the buffer the process must accommodate the smallest set each set which is 158 ms. Card time is 158 ms per card (149 and 9 ICG). The processing time for a conventional bander is 2.4 sec.

Broadly, the collation system of FIG. 1 for collating and banding sets of media, i.e., system 10, includes drive belts 12 that mate with idler belts 14 and thereby drive greeting cards 20 into Bins 1 through 6. Each Bin includes a rear wall 18 and a front wall 16 and side (not shown) and bottom walls 60 that are part of a conventional flighted pusher buffer transport that is positioned orthogonal to the incoming direction of cards 20. A suitable flighted pusher buffer transport is shown in U.S. Pat. No. 8,371,568 which is incorporated herein by reference. Another suitable pusher buffer transport is sold by Shuttleworth North America, 10 Commercial Road, Huntington, Ind. 46750 as a zoned stop conveyor for loose paper. As shown in FIG. 1, Bins 4-6 have been filled and Bins 1-3 are in the process of being filled. Cards 20 are diverted into the Bins with the use of diverter a 30 that is positioned below belt 12 and adapted when actuated to deflect cards into Bins 1-6. As the left most Bins 1-3 are being collated, Bins 4-6 are being pushed in the cross process direction or out of the page as a group 40 to be buffered for a downstream process which could include banding.

Figure 2:
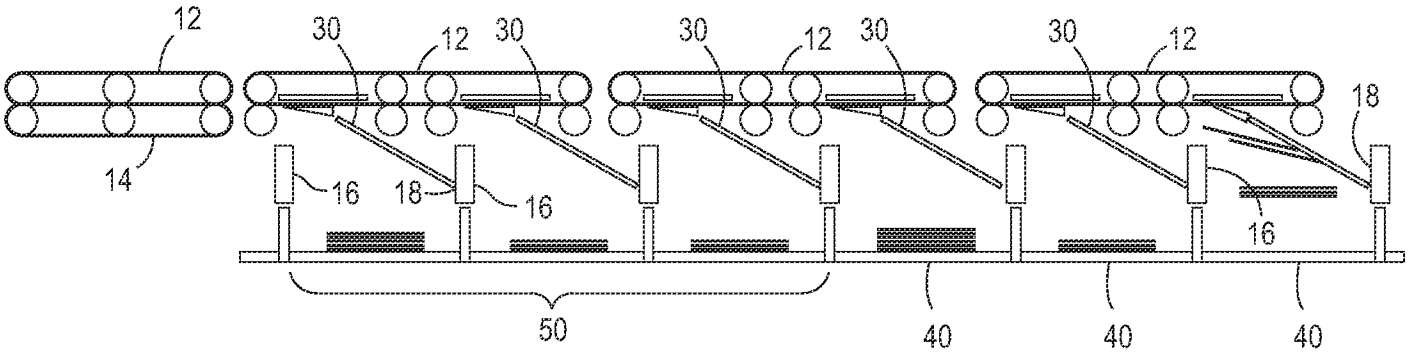
FIG. 2 is a schematic, partial side view illustration of a multi-bin collation system of FIG. 1 now with bins 1-3 full and bins 4-6 being filled. Bins 1-3 are being pushed out of the page to the buffer system so that a new row of 6 sets can be started.

In FIG. 2, collation system 10 is shown with Bins 1-3 full and Bins 4-6 being filled. Bins 1-3 are being pushed out of the page to start a new row of 6 sets that are shown more clearly in FIG. 3. It should be understood that the Bin number and combination of how many get pushed can be altered to best suit customer requirements. In the present configuration only 2 pusher/actuators are needed. One for Bins 1-3 and one for Bins 4-6. This allows for continuous flow of incoming cards and allows time for the drop on cards onto conveyor 150 in FIG. 3.

Figure 3:
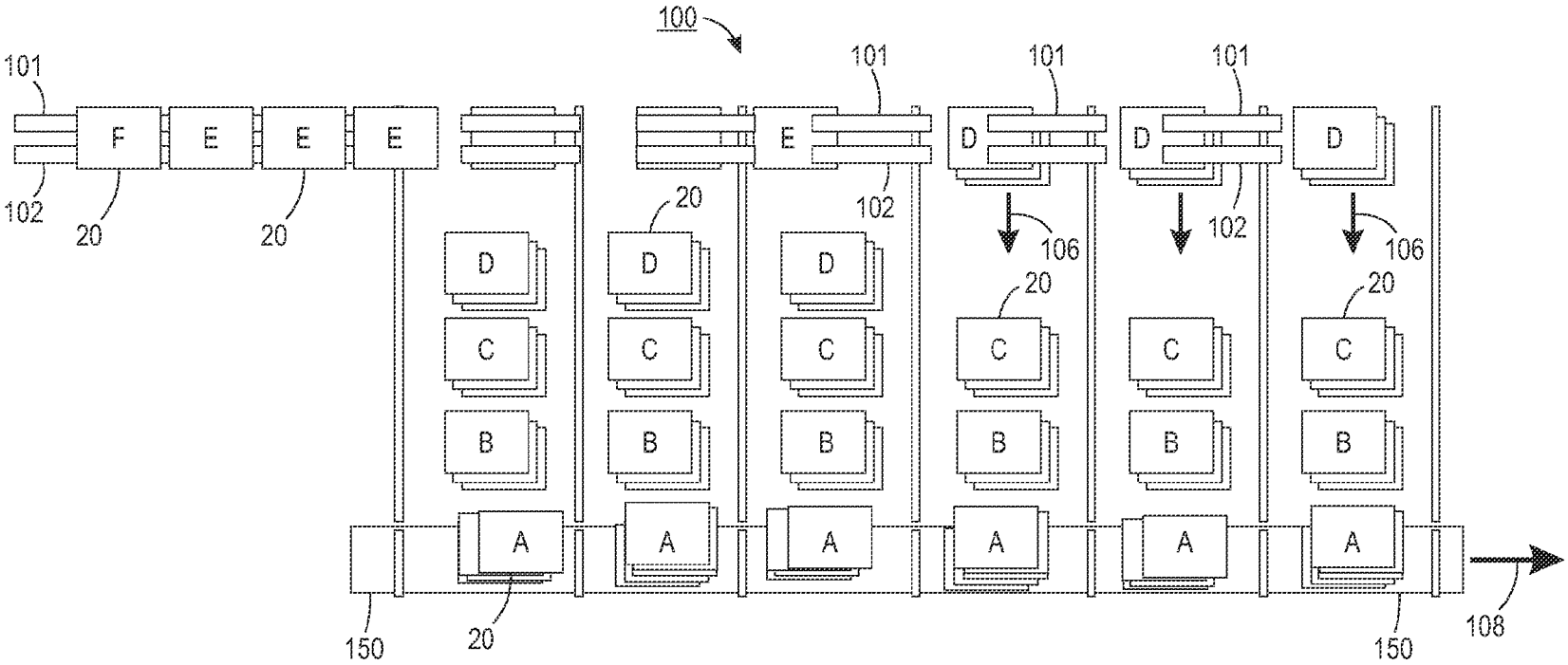
FIG. 3 is a schematic, outboard partial top view illustration of the multi-bin collation system of FIG. 1 showing cards being collated and then buffered in rows of 6 sets.

In FIG. 3, an outboard image of the multi-bin collation system of the present disclosure is shown including belts 101 and 102 conveying a stream of cards 20 with the cards being collated and then buffered in rows of 6 sets. In use, an inboard mirror image of the system as shown in FIG. 3 would be included to accommodate the two streams of greeting card input. The cards 20 are collated and then buffered in rows of 6 sets. That is, 6 sets of A, 6 sets of B, 6 sets of C and 3 sets of D awaiting an additional 3 sets of D to be pushed into line with the waiting 3 sets of D. Each set is a different customer job ranging from 2-100+ cards.

Figure 4:
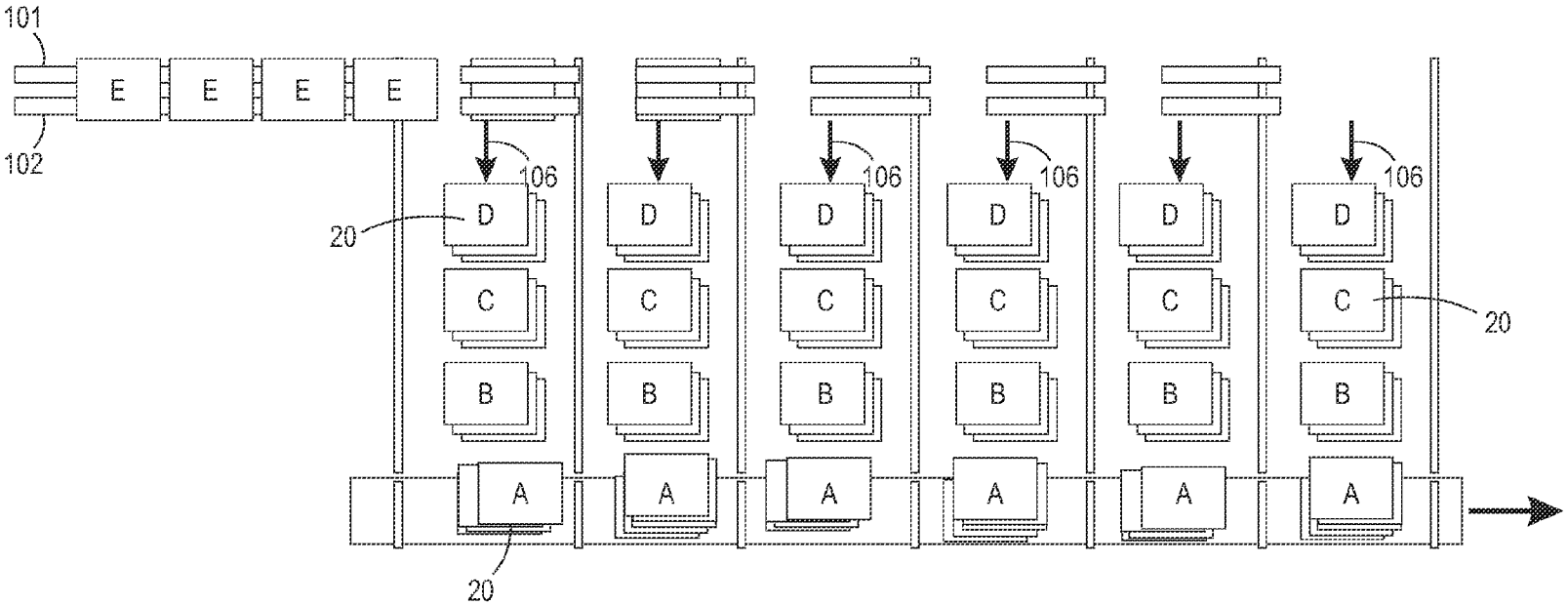
FIG. 4 is a schematic, outboard partial top view illustration of an alternative embodiment of the multi-bin collation system of FIG. 1 showing all columns of card sets being moved as a group.

In FIG. 4, an alternative embodiment of the present disclosure shows cards 20 collated from right to left and then buffered in rows of 6 sets. That is, 6 sets of A, 6 sets of B, 6 sets of C and 6 sets of D. Here all rows of card sets A through D are indexed in unison in the direction of arrows 106 simultaneously with card sets E entering into the bins. The bins are always filled from right to left and the time it takes the cards to traverse all the way to the bin at the right is used to move the previously collected sets out from under the incoming diverter system and provide new empty bins or pockets if using a belt or pusher system. In this way, only one pusher actuator is required for the pusher system. In this embodiment, bins are always filled from right to left if cards enter from the left. Card sets from all of the bins being collected are simultaneously moved into a buffer area and subsequently moved onto a conveyor.

Depending on the banding tact time, it may be desired to out-sort smaller sets. This can be done with an additional Bin or Bins and a diverter to divert those sets to another non-banding conveyor system.

In practice, to meet a demand for collating and banding a high volume of greeting cards per printing, an outboard mirror image half of a fully automated high speed multi-bin card collation system 100 is disclosed that includes two streams of cards with each stream being sent to a series of 6 Bins. While 6 Bins are shown, it should be understood that the number of Bins used would be what is optimal for the user. Diverters channel or direct the stream of cards to sequential Bins based on customer requirements contained on a header sheet included for each requested set of cards which could be from 2 to over 100 cards per customer. The header card is the last card in a customer job and contains a barcode or other means that has the data for that customer including customer name, number of cards, etc. The Bins are filled sequentially with cards from left to right as viewed in FIG. 3. As shown, a flighted pusher buffer system has already pushed 3 rows of 6 sets of cards A through C from the Bins either onto or adjacent to conveyor 150 for transport to a downstream bander. Three collated card sets D have been pushed into a buffer position awaiting a second grouping of 3 card sets D to be moved by the flighted pusher buffer system into position in the direction of arrows 106. Once all 6 card sets of row D are in place, conveyor 150 is moved in the direction of arrow 108 to transport the card sets of row A to a bander and to make room for the pusher system to index and move the 6 card sets of row B onto the conveyor. While the pusher system moves 3 sets of cards orthogonal toward conveyor 150 at one time, the card sets could be moved individually, if desired. Also, flighted pusher buffer transport could have moveable members as side walls that would be adapted to move into and out of slots within a belt moving in the cross process direction. The movable walls could be raised or lowered as needed as the card sets are indexed toward conveyor 150. The number of bins can by optimized to meet specific requirements.

Multi-bin card collation system 100 includes the ability to collate multiple sets so that the conveyor does not have to increment on 2 card sets (158 ms) and has the ability to smooth card count collation time based on average set size by mixing small and large sets in multiple bins prior to being pushed into the buffer zone.

It should now be understood that a fully automated multi-bin card collation and buffering system has been disclosed that is capable of collating cards at high speed. The system takes die-cut cards and diverts those cards on a customer by customer basis into multiple bins. The multi-bin diverter system includes a buffer to allow for high speed collation of sets while providing a buffer for downstream processing. Cards coming into the bins are from right to left for the first three sets and then a second three sets of cards. This allows for the second three bins to be collated while first three sets of cards are shifted first from the bins to a buffer and then in groups of 6 sets to a conveyor which transports them downstream for further processing. This buffering technique gives the multi-bin card collation and buffering system the ability to provide card collation size buffering for varying distributions of set sizes to allow for small sets to be offset by larger sets to increase average processing times for downstream systems, such as, banders. Alternatively, all 6 Bins can be filled from right to left and then indexed on a belt or other conventional pusher system as the leading card of the next job feeds to the right most Bin.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for automatically collating and buffering sets of cards in a multi-bin collation system, comprising:

providing a series of bins for receiving individual sets of cards;

providing each of said bins with fixed front and rear walls;

providing a part of a pusher buffer system as a floor of each of said series of bins;

providing a feed system for feeding cards over each of said series of bins;

providing a diverter for each of said series of bins for deflecting said sets of cards into separate of said of said series of bins;

filling a first grouping of said series of bins with said sets of cards;

using said pusher buffer system to move said first grouping of cards into a buffering zone while simultaneously filling a second grouping of said sets of cards into said series of bins;

using said pusher buffer system to move said second grouping of cards into the buffering zone;

providing a conveyor for transporting said sets of cards downstream from said series of bins;

providing a plurality of separate groupings of sets of cards in said buffer zone before moving any of said grouping of sets of cards onto said conveyor; and simultaneously moving said first and second groupings of sets of cards onto said conveyor while sets of cards are being simultaneously diverted into said series of bins.

2. The method of claim 1, including providing each of said separate groupings of sets of cards positioned in-line with each other in a downstream direction.

3. The method of claim 2, including moving said first and second groupings of sets of cards into said buffer zone three sets at a time.

4. The method of claim 3, including filling said series of bins sequentially from right to left and then from left to right.

5. The method of claim 1, including providing a buffer of at least two of said separate groupings of sets of cards before a separate grouping of cards is moved onto said conveyor.

6. The method of claim 5, including moving said conveyor in a downstream direction to transport said sets of cards for further processing.

7. The method of claim 1, including filling said series of bins sequentially from the furthest away to a nearest bin with respect to said feeding system.

8. A method for collating and buffering sets of cards, comprising:

providing a series of bins for receiving individual sets of cards;

providing a feed source for feeding cards over each of said series of bins;

filling said series of bins from right to left and then from left to right in order to allow for a multiple of said series of bins to be collated with sets of cards while sets of cards from others of said series of bins are shifted into buffering and then onto a conveyor;

providing a diverter for each of said series of bins for deflecting said sets of cards into separate of said of said series of bins;

moving each of said sets of cards from said series of bins into a buffering system;

buffering said sets of cards for a predetermined period of time; and pushing said sets of cards from said buffering system onto a conveyor for transporting said sets of cards from said buffering system to a downstream location.

9. The method of claim 8, including using flighted pusher members to move said sets of cards from said buffering system onto said conveyor.

10. The method of claim 8, wherein said buffering of said sets of cards facilitates varying distributions of card set sizes to allow for small card sets to be offset by larger card sets to increase average processing times for downstream processing.

11. The method of claim 8, wherein said buffering of said sets of cards is to allow for high speed collation of sets of cards while simultaneously providing a buffer for said downstream processing.

12. The method of claim 8, including always feeding cards from said source to fill the bin furthest away from said source first and then filling bins in sequence back from said bin furthest away to the bin nearest said source.

13. The method of claim 8, including indexing all of said sets of cards from said series of bins in unison while simultaneously feeding sets of cards into said series of bins.

14. A method for automating card set collation in a multi-bin system, comprising:

providing multiple bins for receiving individual sets of cards;

filling said multiple bins beginning with the furthest bin from said feed source and then sequentially backwards and then moving card sets from all of said multiple bins orthogonally with respect to cards fed from said feed source into a buffering zone while the next incoming card set is being fed simultaneously from said feed source into said furthest bin from said feed source;

providing a pusher arrangement with a portion of said arrangement serving as a floor for each of said multiple of bins;

providing a feed source for feeding cards over each of said multiple bins;

providing a diverter for each of said multiple bins for diverting said sets of cards into separate of said of said multiple bins;

using said pusher arrangement to move said sets of cards into the buffering zone;

providing a conveyor for transporting said sets of cards downstream from said series of bins; and using said pusher arrangement to move said sets of cards from said buffering zone onto said conveyor.

15. The method of claim 14, including always filling said bins beginning with the furthest bin from said feed source and then sequentially backwards.

16. The method of claim 15, storing said sets of cards within said buffering zone for a predetermined period of time before moving them onto said conveyor.

* * * * *